United States Patent [19]

Klett

[11] 4,230,406

[45] Oct. 28, 1980

[54] CLEANING SYSTEM FOR AN ELECTROSTATIC COPIER

[75] Inventor: Stanley D. Klett, Fairport, N.Y.

[73] Assignee: Xerox Corporation, Stamford, Conn.

[21] Appl. No.: 23,936

[22] Filed: Mar. 26, 1979

[51] Int. Cl.[3] ..... G03G 21/00

[52] U.S. Cl. ..... 355/15; 15/256.51; 15/256.52; 355/16

[58] Field of Search ..... 355/3 R, 3 BE, 15, 16; 15/100, 256.51, 256.52

[56] References Cited

U.S. PATENT DOCUMENTS

| | | | |
|---|---|---|---|
| 2,751,616 | 6/1956 | Turner et al. | 15/77 |
| 2,752,271 | 6/1956 | Walkup et al. | 134/1 |
| 2,832,977 | 5/1958 | Walkup et al. | 15/1.5 |
| 3,221,622 | 12/1965 | Aser et al. | 355/3 R |
| 3,278,972 | 10/1966 | Hudson | 15/308 |
| 3,483,679 | 12/1969 | Balbierer | 55/367 |
| 3,534,427 | 10/1970 | Severynse | 15/301 |
| 3,685,485 | 8/1972 | Kutsuwada et al. | 355/3 R X |
| 3,717,409 | 2/1973 | Hespenheide | 355/15 |
| 3,722,465 | 3/1973 | Krautzberger | 15/256.51 X |
| 3,788,203 | 1/1974 | Rhodes | 355/3 R X |
| 3,792,925 | 2/1974 | Milligan et al. | 355/15 |
| 3,807,853 | 4/1974 | Hudson | 355/15 |
| 4,068,937 | 1/1978 | Willemse et al. | 355/3 TR |
| 4,096,826 | 6/1978 | Stange | 118/656 |
| 4,169,673 | 10/1979 | Sato et al. | 355/3 TR |

*Primary Examiner*—Fred L. Braun

*Attorney, Agent, or Firm*—H. M. Brownrout; C. A. Green; H. Fleischer

[57] ABSTRACT

An apparatus which cleans particles from a photoconductive member arranged to advance along a predetermined path. When the photoconductive member is stationary, the particle cleaner and photoconductive member are spaced from one another. The photoconductive member is deflected into engagement with the particle cleaner in response to the photoconductive member advancing along the pre-determined path. In this manner, the particle cleaner removes residual particles from the photoconductive member during the movement thereof along the pre-determined path.

14 Claims, 5 Drawing Figures

CLEANING SYSTEM FOR AN ELECTROSTATIC COPIER

This invention relates generally to an apparatus for cleaning particles from a photoconductive member arranged to move in a pre-determined path. An apparatus of this type is frequently employed in an electrophotographic printing machine. In an electrophotographic printing machine, it is frequently necessary to remove residual particles from the photoconductive member after the transfer of the particle image to the copy sheet.

Generally, an electrophotographic printing machine includes a photoconductive member which is charged to a substantially uniform potential so as to sensitize its surface. The charged portion of the photoconductive surface is exposed to a light image of an original document being reproduced. This records an electrostatic latent image on the photoconductive surface corresponding to the informational areas contained within the original document being reproduced. After the electrostatic latent image is recorded on the photoconductive surface, the latent image is developed by bringing a developer mixture of carrier granules and toner particles into contact therewith. The toner particles are attracted from the carrier granules to the latent image forming a toner powder image on the photoconductive surface. Frequently, residual toner particles remain adhering to the photoconductive surface after the transfer of the toner powder image to the copy sheet. These toner particles are removed from the photoconductive surface. by a cleaning apparatus. After the toner particles have been transferred to the copy sheet, they are generally heated to permanently affix them to the copy sheet in image configuration. This general approach was disclosed by Carlson in U.S. Pat. No. 2,297,691, and has been further amplified and described by many related patents in the art.

Hereinbefore, toner particles or any other residual particles have been cleaned from the photoconductive member by such techniques as employing a cleaning roller in contact with the photoconductive member for removing the particles therefrom. The cleaning roller may be an elongated brush or foam roller. Generally, the cleaning roller remains continually in contact with the photoconductive member. During the stand-by mode of operation or when the printing machine is off, the photoconductive member is stationary. Thus, the same portion of the photoconductive member remains in contact with the cleaning roller. If the photoconductive member is a flexible belt, continual contact with the cleaning roller may introduce a permanent set or deformation therein. Deformations in the photoconductive member are highly undesirable and may cause a degradation in copy quality. In addition, since the cleaning roller is generally resilient, continuous contact may result in a permanent set or deformation therein as well.

Various types of prior art devices have hereinbefore been developed for cleaning particles from a photoconductive member. The following prior art appears to be relevant:

U.S. Pat. No. 2,751,616
Patentee: Turner, Jr. et al.
Issued: June 26, 1956
U.S. Pat. No. 2,752,271
Patentee: Walkup et al.
Issued: June 26, 1956
U.S. Pat. No. 2,832,977

Patentee: Walkup et al.
Issued: May 6, 1958
U.S. Pat. No. 3,221,622
Patentee: Aser et al.
Issued: Dec. 7, 1965
U.S. Pat. No. 3,278,972
Patentee: Hudson
Issued: Oct. 18, 1966
U.S. Pat. No. 3,483,679
Patentee: Balbierer
Issued: Dec. 16, 1969
U.S. Pat. No. 3,534,427
Patentee: Severynse
Issued: Oct. 20, 1970
U.S. Pat. No. 3,685,485
Patentee: Kutsuwada et al.
Issued: Aug. 22, 1972
U.S. Pat. No. 3,807,853
Patentee: Hudson
Issued: Apr. 30, 1974
U.S. Pat. No. 4,096,826
Patentee. Stange
Issued: June 27, 1978

The pertinent portions of the foregoing prior art may be briefly summarized as follows:

Turner, Jr. et al., the Walkup et al. patents, Aser et al., Hudson (3,278,972), Balbierer, Severynse and Kutsuwada et al. all disclose brush rollers for cleaning particles from a photoconductive member.

Hudson (3,807,853) discloses a polyurethane foam roller for cleaning the photoconductive member.

Stange describes a flexible belt which is deflected into and out of contact with a magnetic brush development system. A pulsating air stream is fed into the deflector and provides an air cushion for the belt passing thereover. The deflector is actuated when the latent image moves into the development zone. Actuation of the deflector, causes the belt to be moved in a direction substantially normal to the direction of movement thereof. In this way, the latent image is moved into contact with the magnetic brush so as to deposit particles thereon in image configuration.

In accordance with the features of the present invention, there is provided an apparatus for cleaning particles from a photoconductive member arranged to move along a pre-determined path. The apparatus includes means, normally spaced from the photoconductive member, for removing particles therefrom. The removing means is inoperative when spaced from the photoconductive member and operative when in contact therewith. Means, responsive to the photoconductive member advancing along the pre-determined path, deflect the photoconductive member from a position spaced from the removing means to a position in contact therewith. In response to the photoconductive member being stationary, the moving means return the photoconductive member from the position contacting the removing means to the position spaced therefrom.

Other aspects of the present invention will become apparent as the following description proceeds and upon reference to the drawings, in which.

While the present invention will hereinafter be described in connection with preferred embodiments thereof, it will be understood that it is not intended to limit the invention to these embodiments. On the contrary, it is intended to cover all alternatives, modifications and equivalents as may be included within the spirit and scope of the invention as defined by the appended claims.

Figure 1:
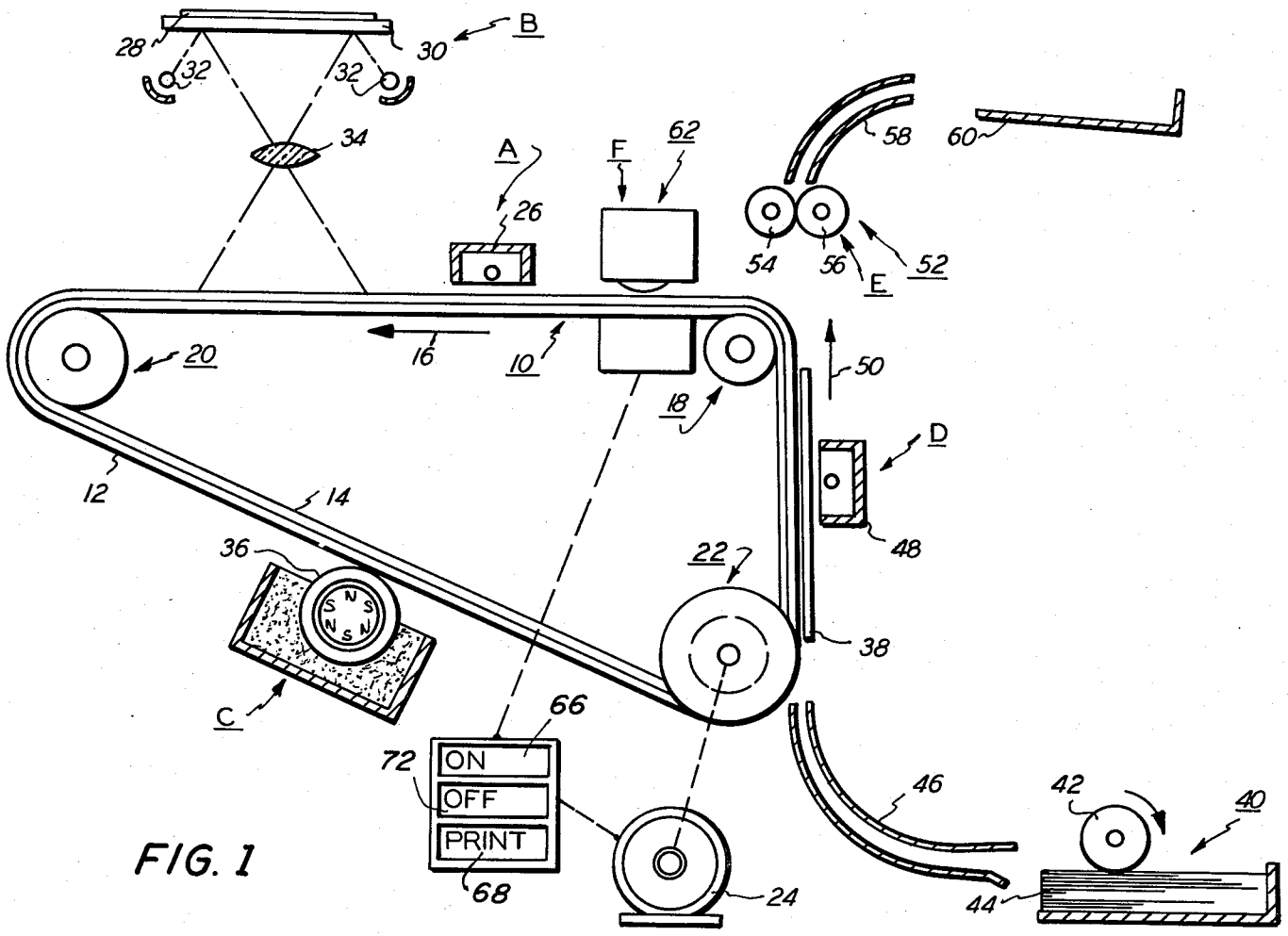
FIG. 1 is a schematic elevational view illustrating an electrophotographic printing machine incorporating the features of the present invention therein.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the cleaning apparatus of the present invention therein. It will become evident from the following discussion that the cleaning apparatus is equally well suited for use in a wide variety of electrostatographic printing machines and is not necessarily limited in its application to the particular embodiment shown herein.

Inasmuch as the art of electrophotographic printing is well known, the various processing stations in the FIG. 1 printing machine will be shown hereinafter schematically and their operation described briefly with reference thereto.

As shown in FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy. Belt 10 moves in the direction of arrow 16 to advance successive portions of photoconductive surface 12 sequentially through the various processing stations disposed about the path of movement thereof. Belt 10 is entrained about stripping roller 18, tension roller 20, and drive roller 22. Drive roller 22 is mounted rotatably and in engagement with belt 10. Motor 24 rotates roller 22 to advance belt 10 in the direction of arrow 16. Roller 22 is coupled to motor 24 by a suitable means such as a drive belt. Belt 10 is maintained in tension by a pair of springs (not shown) resiliently urging tension roller 20 against belt 10 with the desired spring force. Both stripping roller 18 and tension roller 20 are mounted rotatably. These rollers are idlers which rotate freely as belt 10 moves in the direction of arrow 16.

With continued reference to FIG. 1, initially a portion of belt 10 passes through charging station A. At charging station A, a corona generating device, indicated generally by the reference numeral 26, charges photoconductive surface 12 of belt 10 to a relatively high, substantially uniform potential.

Next, the charged portion of photoconductive surface 12 is advanced through exposure station B. At exposure station B, an original document 28 is positioned face-down upon transparent platen 30. Lamps 32 flash light rays onto original document 28. The light rays reflected from original document 28 are transmitted through lens 34 forming a light image thereof. The light image is projected onto the charged portion of photoconductive surface 12 to selectively dissipate the charge thereon. This records an electrostatic latent image on photoconductive surface 12 which corresponds to the informational areas contained within original document 28.

Thereafter, belt 10 advances the electrostatic latent image recorded on photoconductive surface 12 to development station C. At development station C, a magnetic brush developer roller 36 advances the developer mix into contact with the electrostatic latent image. The latent image attracts the toner particles from the carrier granules forming a toner powder image on photoconductive surface 12 of belt 10.

Belt 10 then advances the toner powder image to transfer station D. At transfer station D, a sheet of support material 38 is moved into contact with the toner powder image. The sheet of support material is advanced by sheet feeding apparatus 40 to transfer station D. Preferably, sheet feeding apparatus 40 includes a feed roll 42 contacting the upper sheet of stack 44. Feed roll 42 rotates to advance the uppermost sheet from stack 44 into chute 46. Chute 46 directs the advancing sheet of support material into contact with photoconductive surface 12 of belt 10 in a timed sequence so that the toner powder image developed thereon contacts the advancing sheet of support material at transfer station D. Transfer station D includes a corona generating device 48 which sprays ions onto the backside of sheet 38. This attracts the toner powder image from photoconductive surface 12 to sheet 38. After transfer, the sheet continues to move in the direction of arrow 50 onto a conveyor (not shown) which advances the sheet to fusing station E.

Fusing station E includes a fuser assembly, indicated generally by the reference numeral 52, which permanently affixes the transferred toner powder image to sheet 38. Preferably, fuser assembly 52 includes a heated fuser roller 54 and a back-up roller 56. Sheet 38 passes between fuser roller 54 and back-up roller 56 with the toner powder image contacting fuser roller 54. In this manner, the toner powder image is permanently affixed to sheet 38. After fusing, chute 58 guides the advancing sheet 38 to catch tray 60 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a cleaning roller, indicated generally by the reference numeral 62. A pneumatic system, indicated generally by the reference numeral 64 moves or deflects belt 10 in a direction substantially normal to the direction of movement thereof, as indicated by arrow 16, so that photoconductive surface 12 is in engagement with cleaning roller 62. The detailed structure of cleaning roller 62 and pneumatic system 64 will be described hereinafter with reference to FIGS. 2 through 5, inclusive. After cleaning, a discharge lamp (not shown) floods photoconductive surface 12 with light to dissipate any residual electrostatic charge remaining thereon prior to the charging thereof for the next successive imaging cycle.

Operation of the electrophotographic printing machine is initiated by actuating "ON" button 66. Depression of the "ON" button energizes the various components within the printing machine to a stand-by condition. In the stand-by mode, the various processing stations of the printing machine are brought to their operating conditions. However, in the stand-by mode of operation, belt 10 is stationary inasmuch as motor 24 is de-energized. Similarly, pneumatic system 64 is de-activated. Thus photoconductive surface 12 of belt 10 is spaced from cleaning roller 62. After a suitable period of time has elapsed, a "READY" light is displayed. The machine operator may now depress "PRINT" button 68. Actuation of "PRINT" button 68 energizes motor 22 and pneumatic system 64. One skilled in the art will appreciate that actuation of the "PRINT" button may merely close a relay which couples the blower of pneumatic system 64 and motor 24 with a power supply. Thus, depression of "PRINT" button 68 actuates motor 24 and pneumatic system 64. At this time, belt 10 advances in the direction of arrow 16. In addition, pneumatic system 64 moves belt 10 in a direction substantially normal to the direction of movement thereof, as indicated by arrow 16, so as to position a portion thereof in contact with cleaning roller 62. Hence, as belt 10 moves in the direction of arrow 16, particles are removed therefrom by cleaning roller 62 which is in engagement therewith. After the requisite number of copies have been reproduced, the printing machine automatically returns to the stand-by mode. Thus, pneumatic system 64 and motor 24 are once again de-energized. In the stand-by mode, the photoconductive surface 12 of belt 10 is spaced from cleaning roller 62. This prevents the formation of a permanent set or deformation in any portion of belt 10 or cleaning roller 62 due to a prolonged period of engagement therebetween. In the event the operator wishes to shut the machine down, "OFF" button 72 is depressed. Actuation of "OFF" button 70 shuts down the machine and returns it to the non-operating mode. It is clear that the printing machine operates in three modes. In the "ON" mode, caused by actuation of "ON" button 66 and "PRINT" button 68, belt 10 moves in the direction of arrow 16 and pneumatic system 64 deflects belt 10 into engagement with cleaning roller 62. A second mode of operation is the stand-by mode, initiated by depression of "ON" button 66. In this mode of operation, the various sub-assemblies within the printing machine are brought to their operating conditions. However, belt 10 is stationary and pneumatic system 64 is de-energized. In this latter mode of operation, belt 10 is spaced from cleaning roller 62. Finally, in the third mode of operation, initiated by depression of "OFF" button 70, the printing machine is totally de-energized and no power is being furnished to any of the processing stations thereof.

It is believed that the foregoing description is sufficient for purposes of the present application to illustrate the general operation of an electrophotographic printing machine incorporating the features of the present invention therein.

Figure 2:
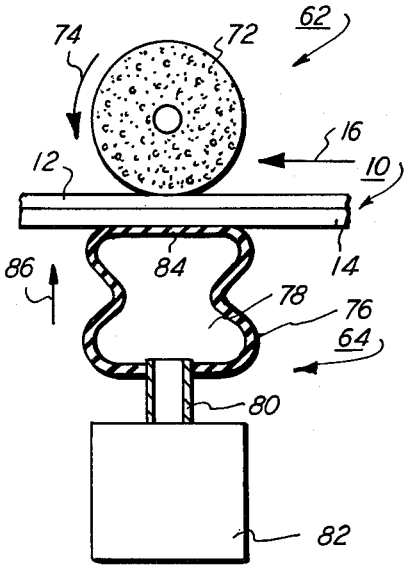
FIG. 2 is an elevational view showing one embodiment of the cleaning system, employed in the FIG. 1 printing machine, in the operative mode.

Referring now to the specific subject matter of the present invention, FIG. 2 depicts one embodiment of the cleaning apparatus. As shown in FIG. 2, belt 10 advances in the direction of arrow 16. Hence, the printing machine is in the operating mode. It is clear that under these circumstances the operator has depressed "PRINT" button 68 (FIG. 1). The cleaning roller depicted in FIG. 2 is preferably made from an open celled polyurethane foam. As depicted thereat, urethane roller 72 rotates in the direction of arrow 74. Pneumatic system 64 includes a flexible diaphragm or bellows 76 defining an interior chamber 78. Preferably, bellows 76 is made from rubber. Conduit 80 couples chamber 78 of bellows 76 with blower 82. Blower 82 furnishes a pressurized fluid, such as air, to chamber 78 causing bellows 76 to expand. Inasmuch as surface 84 of bellows 76 is in contact with substrate 14 of belt 10, expansion of bellows 76 deflects belt 10 in the direction of arrow 86, i.e. substantially normal to the direction of movement of belt 10, as indicated by arrow 16. Bellows 76 expands until photoconductive surface 12 of belt 10 is in contact with roller 72. As roller 72 rotates in the direction of arrow 74, it removes any residual toner particles adhering to photoconductive surface 12 of belt 10.

Figure 3:
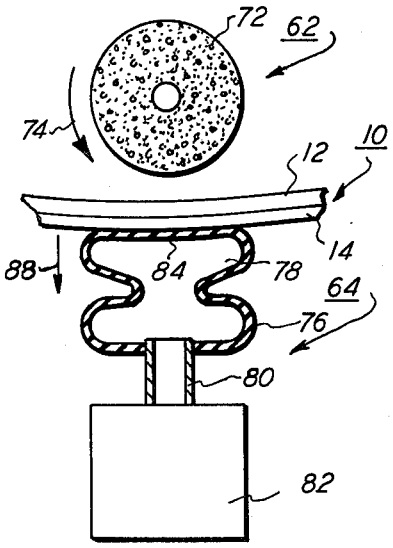
FIG. 3 is an elevational view depicting the FIG. 2 cleaning system in the inoperative mode.

After the requisite number of copies have been reproduced, the printing machine returns to the stand-by mode of operation. FIG. 3 depicts the cleaning apparatus in the stand-by mode of operation. As shown thereat, photoconductive belt 10 is substantially stationary. Blower 82 is no longer energized and the pressurized fluid or air within chamber 78 of bellows 76 is vented therefrom via a valve (not shown). Thus, bellows 76 contracts in the direction of arrow 88. This causes belt 10 to return to its non-deflected condition. In the non-deflected condition, photoconductive surface 12 is spaced from roller 72. Hence, belt 10 no longer engages roller 72, thereby preventing the formation of permanent sets in belt 10 and roller 72. When the machine operator wishes to reproduce the next set of copies with a new original or with the same original, "PRINT" button 68 is once again depressed. Depression of "PRINT" button 68 actuates blower 82 and advances belt 10 along a pre-determined path, as indicated by arrow 16 (FIG. 2). Thus, the cleaning system once again returns to the condition shown in FIG. 2 wherein any residual toner particles adhering to photoconductive surface 12 are removed therefrom.

Figure 4:
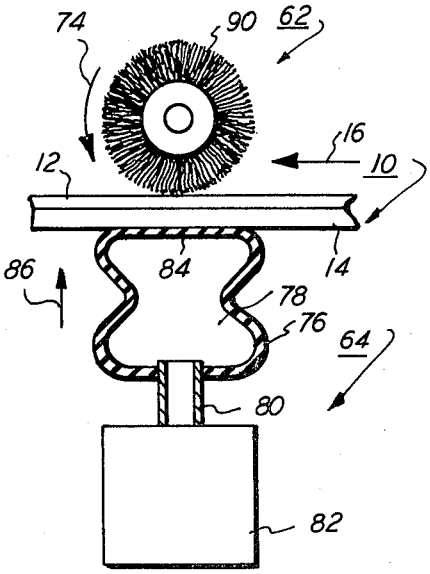
FIG. 4 is an elevational view showing another embodiment of the cleaning system, employed in the FIG. 1 printing machine, in the operative mode.

Another embodiment of the cleaning apparatus is depicted in FIG. 4. As shown thereat, cleaning roller 62 is an elongated brush 90. Brush 90 is mounted rotatably and is adapted to rotate in the direction of arrow 74. Preferably, brush 90 is made from a substantially rigid core having a plurality of fibers extending in a radially outwardly direction. The fibers thereof may be made from a suitable synthetic material such as Dynel or from a natural material such as an animal fur. Once again, FIG. 4 depicts the printing machine in the operating mode, i.e. when "PRINT" button 68 has been energized. Energization of "PRINT" button 68 causes belt 10 to move in the direction of arrow 16, and blower 82 to furnish a supply of pressurized air to chamber 78 of bellows 76 via duct 80. As pressurized air enters chamber 78, bellows 76 expands causing surface 84 to move or deflect belt 10 in the direction of arrow 86. Belt 10 deflects in this direction until photoconductive surface 12 is in engagement with brush 90. At this time, brush 90 removes any residual toner particles remaining adhering to photoconductive surface 12. After the requisite number of copies have been reproduced in the printing machine, the machine returns to the stand-by mode of operation. In this mode of operation, blower 82 is de-energized and belt 10 is substantially stationary.

Figure 5:
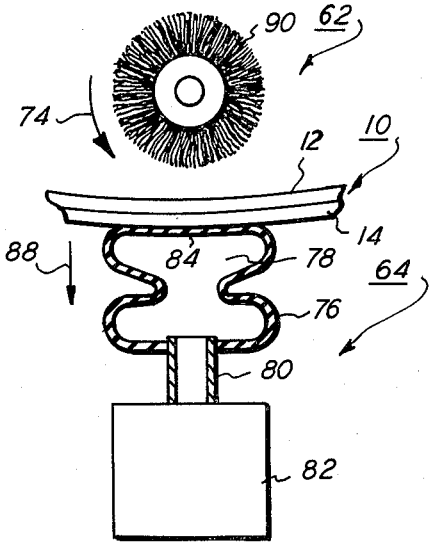
FIG. 5 is an elevational view depicting the FIG. 4 cleaning system in the inoperative mode.

FIG. 5 depicts the condition of the cleaning apparatus when the printing machine is either off or in the stand-by mode of operation. Blower 82 is de-energized and belt 10 is substantially stationary. Thus, bellows 76 retracts to its unexpanded state inasmuch as blower 82 is not furnishing pressurized fluid to interior chamber 78 via duct 80. Hence, surface 84 of bellows 76 moves in the direction of arrow 88 returning belt 10 to the undeflected condition. In this latter state, photoconductive surface 12 is spaced from roller 90. Actuation of the "PRINT" button 68 returns the cleaning apparatus to the condition depicted in FIG. 4. Thus, as belt 10 starts to advance in the direction of arrow 16, blower 82 furnishes pressurized fluid through conduit 80 into chamber 78 of bellows 76. This causes bellows 76 to expand moving surface 84 in the direction of arrow 86 (FIG. 4). As surface 84 moves in the direction of arrow 86, belt 10 deflects in the same direction moving photoconductive surface 12 into engagement with brush 90 so as to remove any residual toner particles adhering thereto.

While the present invention has been described as utilizing either a rotatably mounted elongated brush or rotatably mounted foam roller, one skilled in the art will appreciate that it is not necessarily so limited. A magnetic brush cleaning apparatus may also be employed in lieu thereof. In a magnetic brush cleaning apparatus, a magnetic brush roller having a layer of carrier particles adhering thereto attracts residual toner particles from the photoconductive surface. Other cleaning devices such as blades or webs may also be utilized. As in the rollers hereinbefore described, the pneumatic system deflects the belt into engagement with the cleaning device only when the belt is advancing. When the belt is stationary, the pneumatic system is de-energized and the belt is spaced from the cleaning device. Hence, the foregoing cleaning system may utilize a pneumatic system in conjunction with any type of cleaning device. In all of these systems, the pneumatic system is employed to deflect the belt into and out of engagement with the respective cleaning device.

In recapitulation, the cleaning apparatus of the present invention employs a pneumatic system which is actuated only when the photoconductive belt is advancing. At this time, the pneumatic system deflects the belt so that the photoconductive surface is in engagement with the cleaning roller. When the printing machine is in the stand-by mode or off mode, i.e. when the photoconductive belt is stationary, the pneumatic system is de-energized and the photoconductive belt returns to a position spaced from the cleaning roller. In this manner, permanent deformations of the belt and roller are prevented from occurring.

It is, therefore, evident that there has been provided in accordance with the present invention a cleaning apparatus which fully satisfies the aims and advantages hereinbefore set forth. While this invention has been described in conjunction with specific embodiments thereof, it is evident that many alternatives, modifications and variations will be apparent to those skilled in the art. Accordingly, it is intended to embrace all such alternatives, modifications and variations as fall within the spirit and broad scope of the appended claims.

I claim:

1. An apparatus for cleaning residual particles from a photoconductive member arranged to advance along a pre-determined path after a particle image formed on the photoconductive member has been transferred to a copy sheet, including:

means, normally spaced from the photoconductive member, for removing the residual particles from the photoconductive member, said removing means being inoperative when spaced from the photoconductive member and being operative when in contact therewith; and pneumatic means, operatively associated with the photoconductive member, for deflecting the photoconductive member from a position spaced from said removing means to a position in contact therewith in response to the photoconductive member moving along the predetermined path, said pneumatic means returning the photoconductive member from the position in contact with said removing means to a position spaced from said removing means in response to the photoconductive member being stationary.

2. An apparatus as recited in claim 1, wherein said pneumatic means includes:

a bellows having one surface thereof contacting the photoconductive member; and means for supplying a pressurized fluid to said bellows expanding said bellows to deflect the photoconductive member into contact with said removing means, said supplying means being actuated in response to the photoconductive member advancing along the predetermined path.

3. An apparatus as recited in claims 1, or 2, wherein said removing means includes a rotatable, resilient roll.

4. An apparatus as recited in claim 3, wherein said resilient roll is preferably made from a urethane material.

5. An apparatus as recited in claims 1, or 2, wherein said removing means includes a rotatable elongated brush.

6. An apparatus as recited in claims 1, or 2, wherein the photoconductive member includes a flexible belt.

7. An apparatus as recited in claim 6, wherein said pneumatic means deflects said flexible belt in a direction substantially normal to the direction that said flexible belt advances along the pre-determined path.

8. An electrophotographic printing machine of the type having a photoconductive member arranged to advance along a pre-determined path wherein residual particles adhere to the photoconductive member after transferring a particle image therefrom to a copy sheet, wherein the improvement includes:

means, normally spaced from the photoconductive member, for removing particles from the photoconductive member, said removing means being inoperative when spaced from the photoconductive member and being operative when in contact therewith; and pneumatic means, operatively associated with the photoconductive member, for deflecting the photoconductive member from a position spaced from said removing means to a position in contact therewith in response to the photoconductive member advancing along the pre-determined path, said pneumatic means returning the photoconductive member from the position in contact with said removing means to a position spaced from said removing means in response to the photoconductive member being stationary.

9. A printing machine as recited in claim 8, wherein said pneumatic means includes:

a bellows having one surface thereof contacting the photoconductive member; and means for supplying a pressurized fluid to said bellows expanding said bellows to deflect the photoconductive member into contact with said removing means, said supplying means being actuated in response to the photoconductive member advancing along the pre-determined path.

10. A printing machine as recited in claims 8, or 9, wherein said removing means includes a rotatable, resilient roll.

11. A printing machine as recited in claim 10, wherein said resilient roll is preferably made from a urethane material.

12. A printing machine as recited in claims 8, or 11, wherein said removing means includes a rotatable, elongated brush.

13. A printing machine as recited in claims 8, or 11, wherein the photoconductive member includes a flexible belt.

14. A printing machine as recited in claim 13, wherein said pneumatic means deflects said flexible belt in a direction substantially normal to the direction that said flexible belt advances along the predetermined path.

* * * * *